US008659501B2

(12) United States Patent
Ryou et al.

(10) Patent No.: US 8,659,501 B2
(45) Date of Patent: Feb. 25, 2014

(54) META MATERIAL ANTENNA USING COUPLING IN HELICAL STRUCTURE

(75) Inventors: Byung Hoon Ryou, Seoul (KR); Won Mo Sung, Siheung-si (KR); Gi Ho Kim, Anyang-si (KR); Jeong Keun Ji, Seoul (KR)

(73) Assignee: EMW Co., Ltd., Incheon (KR)

( * ) Notice: Subject to any disclaimer, the term of this patent is extended or adjusted under 35 U.S.C. 154(b) by 384 days.

(21) Appl. No.: 13/129,805

(22) PCT Filed: Nov. 17, 2009

(86) PCT No.: PCT/KR2009/006740

§ 371 (c)(1),
(2), (4) Date: May 17, 2011

(87) PCT Pub. No.: WO2010/058934

PCT Pub. Date: May 27, 2010

(65) Prior Publication Data

US 2011/0221653 A1 Sep. 15, 2011

(30) Foreign Application Priority Data

Nov. 18, 2008 (KR) ..... 10-2008-0114717

(51) Int. Cl.
*H01Q 1/36* (2006.01)

(52) U.S. Cl.
USPC ..... 343/895; 343/722

(58) Field of Classification Search
USPC ..... 343/895, 793, 742, 866, 882, 892
See application file for complete search history.

(56) References Cited

U.S. PATENT DOCUMENTS

| | | | | |
|---|---|---|---|---|
| 5,041,842 | A * | 8/1991 | Blaese | 343/882 |
| 6,028,559 | A * | 2/2000 | Satoh et al. | 343/744 |
| 8,022,878 | B2 * | 9/2011 | Yamagajo et al. | 343/700 MS |
| 8,368,599 | B2 * | 2/2013 | Lim et al. | 343/700 MS |
| 2008/0048917 | A1 | 2/2008 | Achour et al. | |
| 2008/0174503 | A1 * | 7/2008 | Kim et al. | 343/722 |
| 2013/0135164 | A1 * | 5/2013 | Asanuma et al. | 343/749 |

FOREIGN PATENT DOCUMENTS

KR 10-2008-0038552 5/2008

OTHER PUBLICATIONS

PCT International Search Report for PCT Counterpart Application No. PCT/KR2009/006740 containing Communication relating to the Results of the Partial International Search Resort, 4 pgs., (Jun. 18, 2010).

D. H. Lee, et al., "Low Frequency Tunable Metamaterial Small Antenna Structure", The Second European Conference on Antennas and Propagation, pp. 1-5, (Nov. 11-16, 2007).

Jeongpyo Kim, et al., "Tunable Internal Loops Antenna for DVB-H Service", International Workshop on Antenna Technology: Small Antennas and Novel Metamaterials, pp. 235-238, (Mar. 4-6, 2008).

* cited by examiner

*Primary Examiner* — Thien M Le
(74) *Attorney, Agent, or Firm* — The PL Law Group, PLLC

(57) ABSTRACT

There is provided an antenna implementing a first 0-th order resonant frequency using a first radiator to which power is fed through parallel inductors of helical structures, and implementing a second 0-th order resonant frequency using a second radiator to which power is couple-fed through radiation elements put into the helical structures.

6 Claims, 5 Drawing Sheets

META MATERIAL ANTENNA USING COUPLING IN HELICAL STRUCTURE

CROSS-REFERENCE TO RELATED APPLICATIONS

This patent application is a U.S. National Phase application under 35 U.S.C. § 371 of International Application No. PCT/KR2009/006740, filed Nov. 17, 2009, entitled META MATERIAL ANTENNA USING COUPLING IN HELICAL STRUCTURE, which claims priority to Korean patent application number 10-2008-0114717, filed Nov. 18, 2008.

1. Technical Field

The present invention relates to a meta material antenna using helical structures and internal coupling power feed, and more specifically, to a meta material antenna implementing a first 0-th order resonant frequency using a first radiator to which power is fed through parallel inductors of the helical structures, and implementing a second 0-th order resonant frequency using a second radiator to which power is couple-fed through radiation elements put into the helical structures.

2. Background Art

Conventional antennas using a band other than a 0-th order resonant frequency band is largely affected by surrounding and mounting environments.

Generally, in a conventional antenna, a 0-th order resonance is formed at only one frequency, and if two bands are formed, the band is drastically decreased.

SUMMARY

Therefore, the present invention has been made in view of the above problems, and it is an object of the present invention to provide a meta material antenna implementing a first 0-th order resonant frequency using a first radiator to which power is fed through parallel inductors of helical structures, and implementing a second 0-th order resonant frequency using a second radiator to which power is couple-fed through radiation elements put into the helical structures.

To accomplish the above object, according to one aspect of the present invention, there is provided a meta material antenna implementing a first 0-th order resonant frequency using a first radiator to which power is fed through parallel inductors of helical structures, and implementing a second 0-th order resonant frequency using a second radiator to which power is couple-fed through radiation elements put into the helical structures.

According to the present invention, there is provided a meta material antenna implementing a first 0-th order resonant frequency using a first radiator to which power is fed through parallel inductors of helical structures, and implementing a second 0-th order resonant frequency using a second radiator to which power is couple-fed through radiation elements put into the helical structures.

In addition, according to the present invention, there is provided a meta material antenna, in which both of two bands can be least affected by surrounding and mounting environments using two 0-th order resonances.

In addition, according to the present invention, there is provided a meta material antenna, which can solve the bandwidth problem of a 0-th order resonator of a couple power feeding method and minimize interference by using power feeding methods different from each other.

DETAILED DESCRIPTION

A meta material antenna using coupling in helical structures will be hereafter described in detail, with reference to the accompanying drawings.

Figure 1:
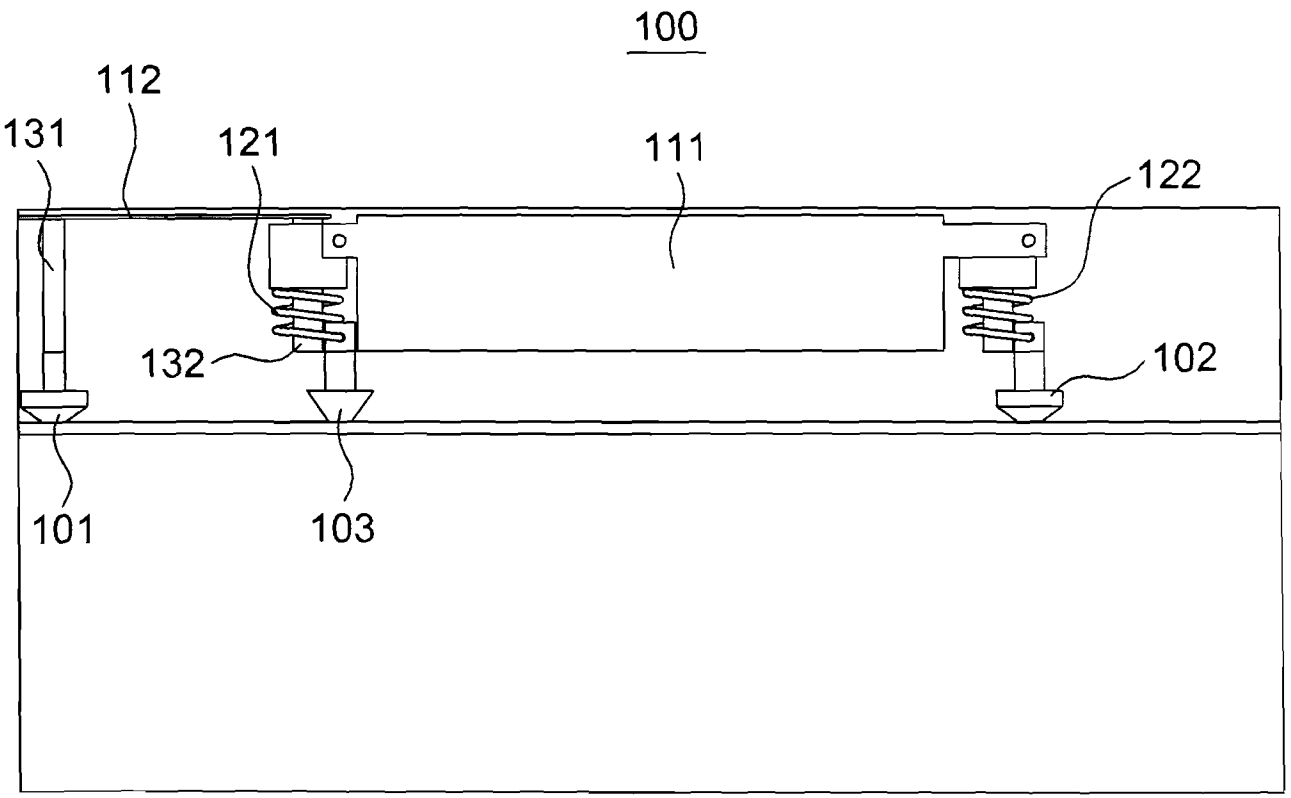
FIG. 1 is a view showing the entire structure of an antenna using parallel inductors of helical structures according to an embodiment of the present invention.

FIG. 1 is a view showing the entire structure of an antenna using parallel inductors of helical structures according to an embodiment of the present invention.

Referring to FIG. 1, the antenna 100 according to an embodiment of the present invention implements a first 0-th order resonant frequency using a first radiator 111 to which power is fed through parallel inductors 101 and 102 of helical structures 121 and 122.

In addition, the antenna 100 according to an embodiment of the present invention implements a second 0-th order resonant frequency using a second radiator 112 to which power is couple-fed through radiation elements put into the helical structures 121 and 122.

In addition, in the antenna 100 according to an embodiment of the present invention, resonant frequency control inductors 101 and 102 are respectively connected to an end of the first and second radiators 111 and 112, and the resonant frequencies can be finely adjusted by changing values of the resonant frequency control inductors.

As described, in the antenna 100 according to an embodiment of the present invention, the resonant frequencies can be adjusted using meta material and coupling power feed.

Accordingly, in the antenna 100 according to an embodiment of the present invention, both of two bands can be least affected by surrounding and mounting environments using two 0-th order resonances.

Figure 2:
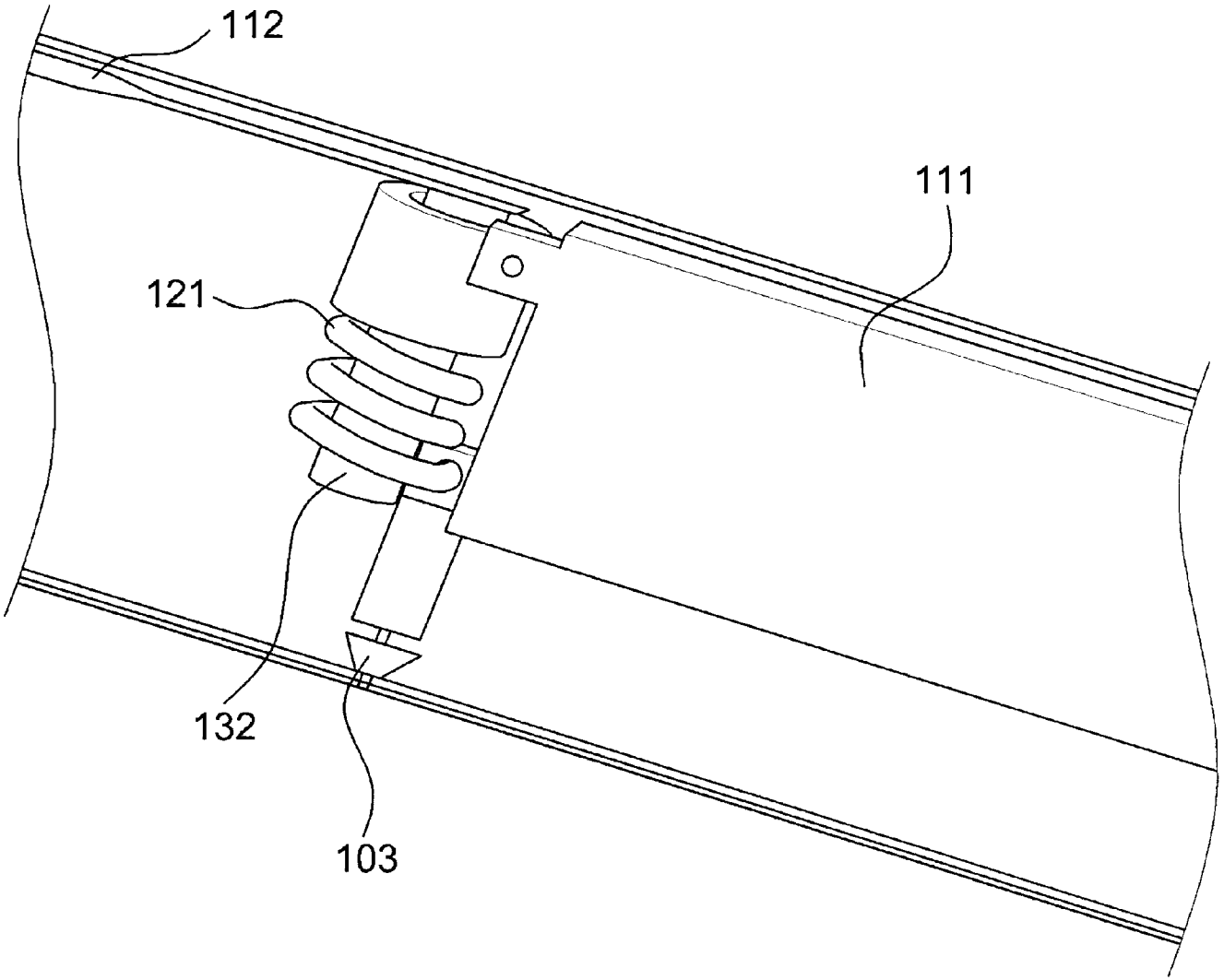
FIG. 2 is a view showing an example of a power feeding unit of an antenna according to an embodiment of the present invention.

FIG. 2 is a view showing an example of a power feeding unit of an antenna according to an embodiment of the present invention.

Referring to FIGS. 1 and 2, in the antenna 100 according to an embodiment of the present invention, the second radiator 112 is put into the cylinder of the helical structure of the first radiator 111, and power is fed to the second radiator through a power feeding unit 103.

Figure 3:
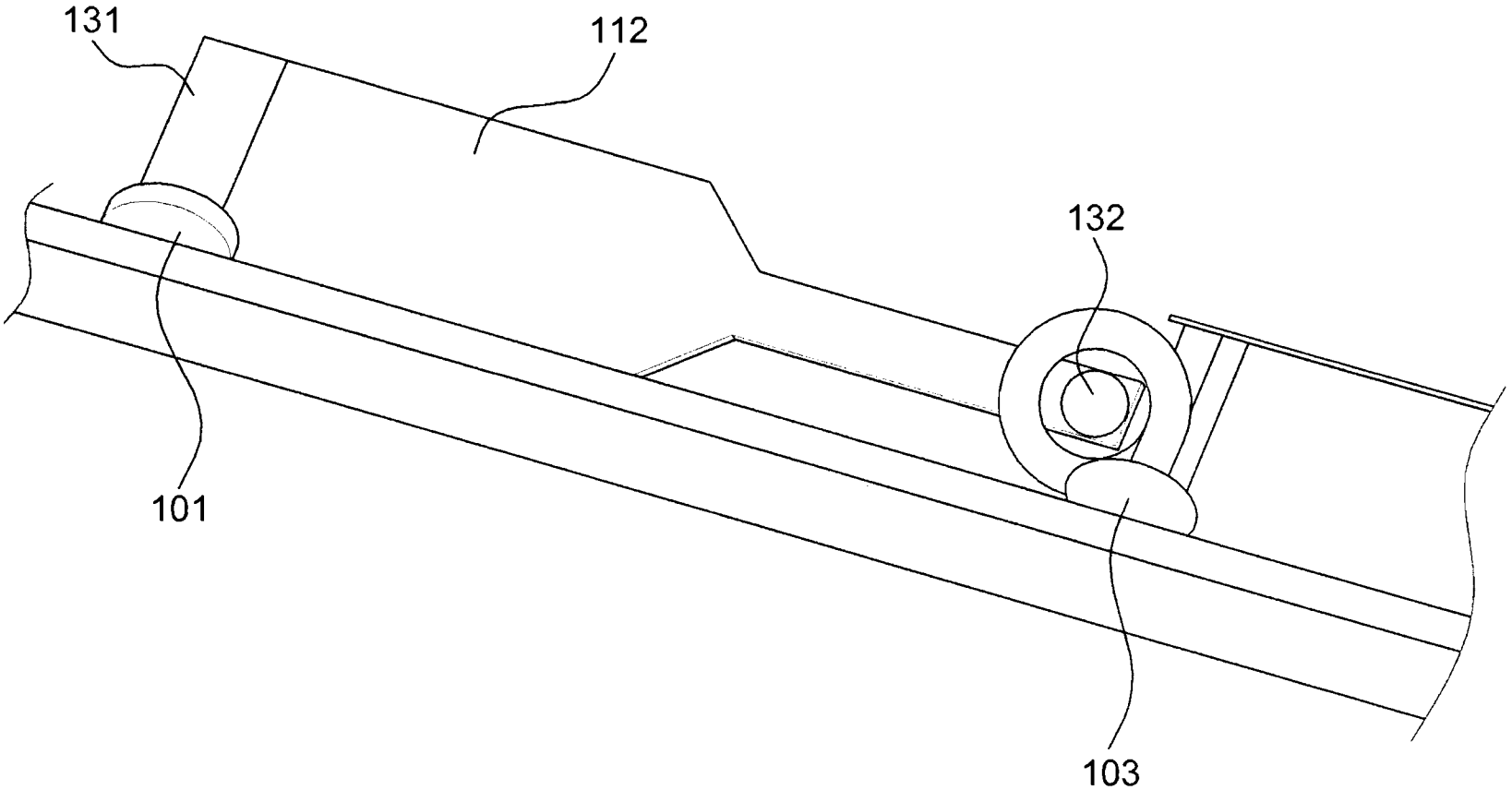
FIG. 3 is a view showing an example of a first control inductor and a power feeding unit of an antenna according to an embodiment of the present invention.

FIG. 3 is a view showing an example of a first control inductor and a power feeding unit of an antenna according to an embodiment of the present invention.

Referring to FIGS. 1 and 3, in the antenna 100 according to an embodiment of the present invention, the first control inductor 101 is connected to the second radiator 112. The second radiator 112 is connected to the power feeding unit 103 through the first helical structure 121.

Figure 4:
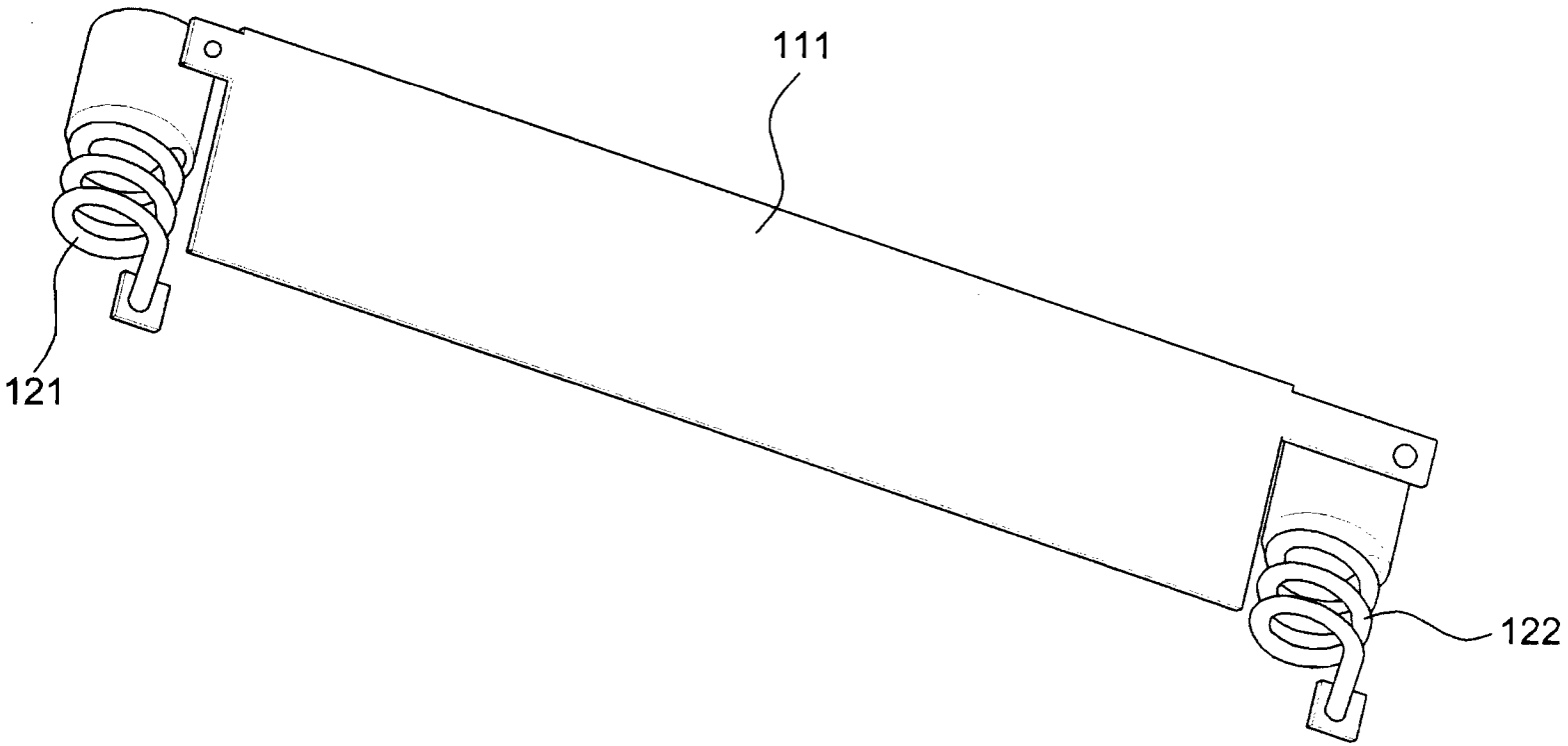
FIG. 4 is a view showing an example of a first radiator constructing an antenna according to an embodiment of the present invention.

FIG. 4 is a view showing an example of a first radiator constructing an antenna according to an embodiment of the present invention.

Referring to FIGS. 1 and 4, in the antenna 100 according to an embodiment of the present invention, helical structures 121 and 122 are disposed at both ends of the first radiator 111.

In the antenna 100 according to an embodiment of the present invention, if there are two second radiators 112, the second radiators 112 can be respectively put into the cylinders of the helical structures 121 and 122 placed at both ends of the first radiator 111.

Figure 5:
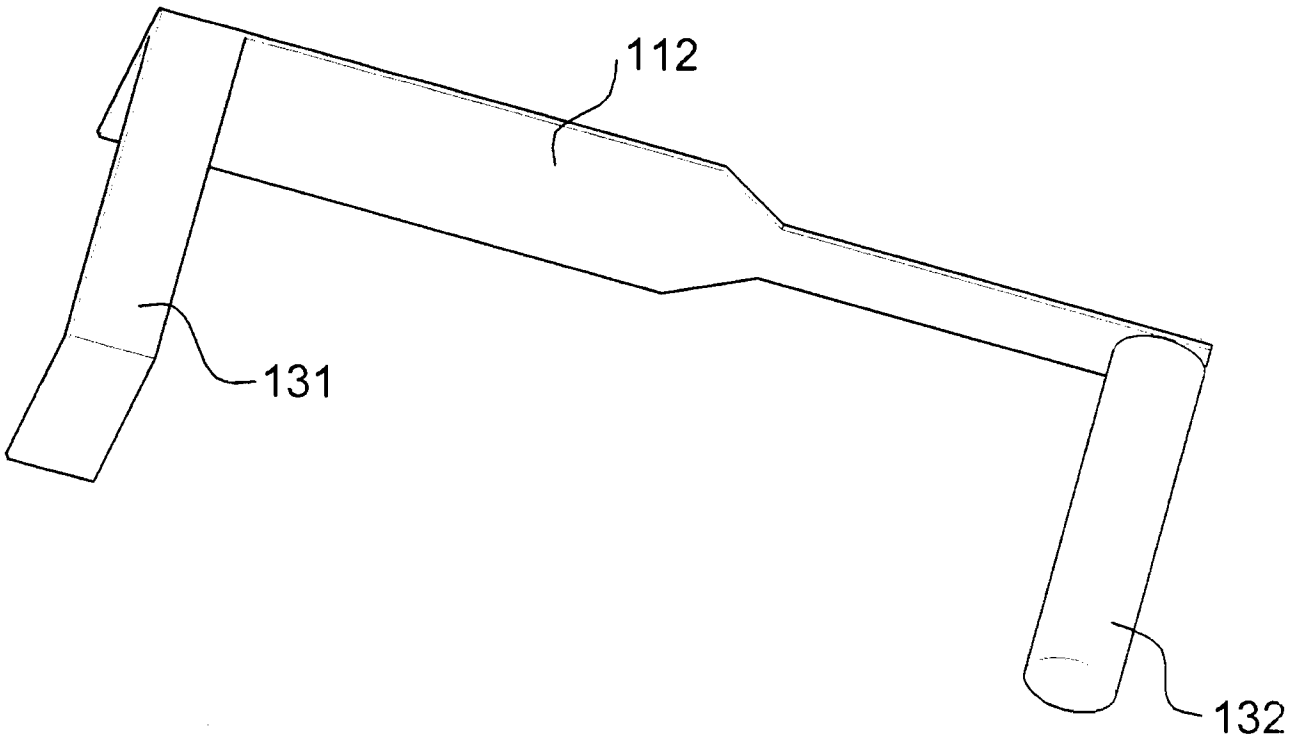
FIG. 5 is a view showing an example of a second radiator constructing an antenna according to an embodiment of the present invention.

FIG. 5 is a view showing an example of a second radiator constructing an antenna according to an embodiment of the present invention.

Referring to FIGS. 1 and 5, in the antenna 100 according to an embodiment of the present invention, coupling amount is adjusted depending on the length or the thickness of a rod-type metallic member 132 put into the helical structure 121 and 122 or a panel-type metallic member 131.

In addition, in the antenna 100 according to an embodiment of the present invention, impedance of the second resonance can be adjusted depending on the adjusted coupling amount.

Therefore, the antenna 100 according to an embodiment of the present invention can solve the bandwidth problem of a 0-th order resonator of a couple power feeding method and minimize interference by using power feeding methods different from each other.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An antenna, comprising:

parallel inductors of helical structures;

a first radiator to which power is fed through the parallel inductors of helical structures, the antenna implementing a first 0-th order resonant frequency using the first radiator; and a second radiator to which power is couple-fed through radiation elements put into the helical structures, the antenna implementing a second 0-th order resonant frequency using the second radiator;

wherein the second radiator is put into a cylinder of a helical structure of the first radiator.

2. The antenna according to claim 1, wherein if there are two second radiators, the second radiators are respectively put into cylinders of the helical structures placed at both ends of the first radiator.

3. The antenna according to claim 1, wherein coupling amount is adjusted depending on a length or a thickness of a rod-type metallic member put into the helical structure or a panel-type metallic member.

4. The antenna according to claim 3, wherein impedance of the second resonance can be adjusted depending on the adjusted coupling amount.

5. The antenna according to claim 1, wherein inductors are respectively connected to an end of the first and second radiators, and the resonant frequencies are adjusted by changing values of the inductors.

6. The antenna according to claim 1, wherein the resonant frequencies are adjusted using meta material and coupling power feed.

* * * * *